United States Patent [19]

Green

[11] 3,979,626

[45] Sept. 7, 1976

[54] ELECTROSTATIC FOCUSING ARRANGEMENTS

[75] Inventor: Michael Curzon Green, London, England

[73] Assignee: Emi-Varian Limited, Hayes, England

[22] Filed: Mar. 27, 1975

[21] Appl. No.: 562,789

[30] Foreign Application Priority Data

Apr. 2, 1974 United Kingdom ..... 14486/74

[52] U.S. Cl. ..... 313/240; 313/241; 313/256; 313/5.34

[51] Int. Cl.[2] ..... H01J 1/53

[58] Field of Search ..... 315/5.34, 3.5; 313/240, 313/241, 242, 252, 256

[56] References Cited

UNITED STATES PATENTS

| | | | |
|---|---|---|---|
| 3,246,195 | 4/1966 | Hoshino et al. | 313/240 |
| 3,449,617 | 6/1969 | Kreuchen et al. | 315/5.34 |

*Primary Examiner*—Saxfield Chatmon, Jr.
*Attorney, Agent, or Firm*—Fleit & Jacobson

[57] ABSTRACT

In electron beam discharge tubes breakdown in the form of a gaseous arc can occur. An improved form of electrode which protects an insulating support against local high-stress fields is described. The electrode has a conductive shield extending to the other side of an interface between the electrode and the insulating support. A mechanism, the "single surface multipactor effect," which could cause the breakdown is also described.

5 Claims, 5 Drawing Figures

6
15
14
7
8
-5-
10
11
12
18
29
19
-4-
17
II
-3-
16
9
13
-2-
-1-

ELECTROSTATIC FOCUSING ARRANGEMENTS

This invention relates to electrostatic focusing arrangements.

The electron beam in a linear beam device, e.g. a klystron, may be focused and confined by periodic electrostatic lenses, (Einzel lenses). These constitute a focusing system of low mass and minimal power requirement which may be obtained from the cathode e.h.t. supply.

Problems arise with such lenses because, although at high electrical potential, they must be precisely located mechanically. This necessitates the use of a solid insulating support, e.g. a ceramic such as alumina, with a precisely ground and shaped mechanical interface to the lens, e.g. a slotted fitting.

Further it is known that replacement of a vacuum gap with a solid insulator renders the gap more liable to electrical breakdown and reduces the voltage which can be supplied to the electrodes. Leakage currents occur through the insulator and, under running conditions, catastrophic heavy-current breakdown can occur. These effects are caused by surface charging of the insulator due to the secondary emission of electrons. This secondary electron emission is initiated by electrons generated by field emission in the intense field at the insulator/negative electrode interface.

It is an object of the present invention to provide an improved electrostatic focusing arrangement in which the problem of breakdown is alleviated.

According to the invention there is provided an electron beam discharge tube having a first electrode, an insulating support and a second, beam focussing, electrode supported by and forming an interface with said support which support, in operation of the tube, is in an electric field formed by a potential difference between said electrodes, the second electrode having a conductive shield extending to the other side of the interface from the electrode to shield the interface from the electric field and thereby protect the support against breakdown.

Figure 1:
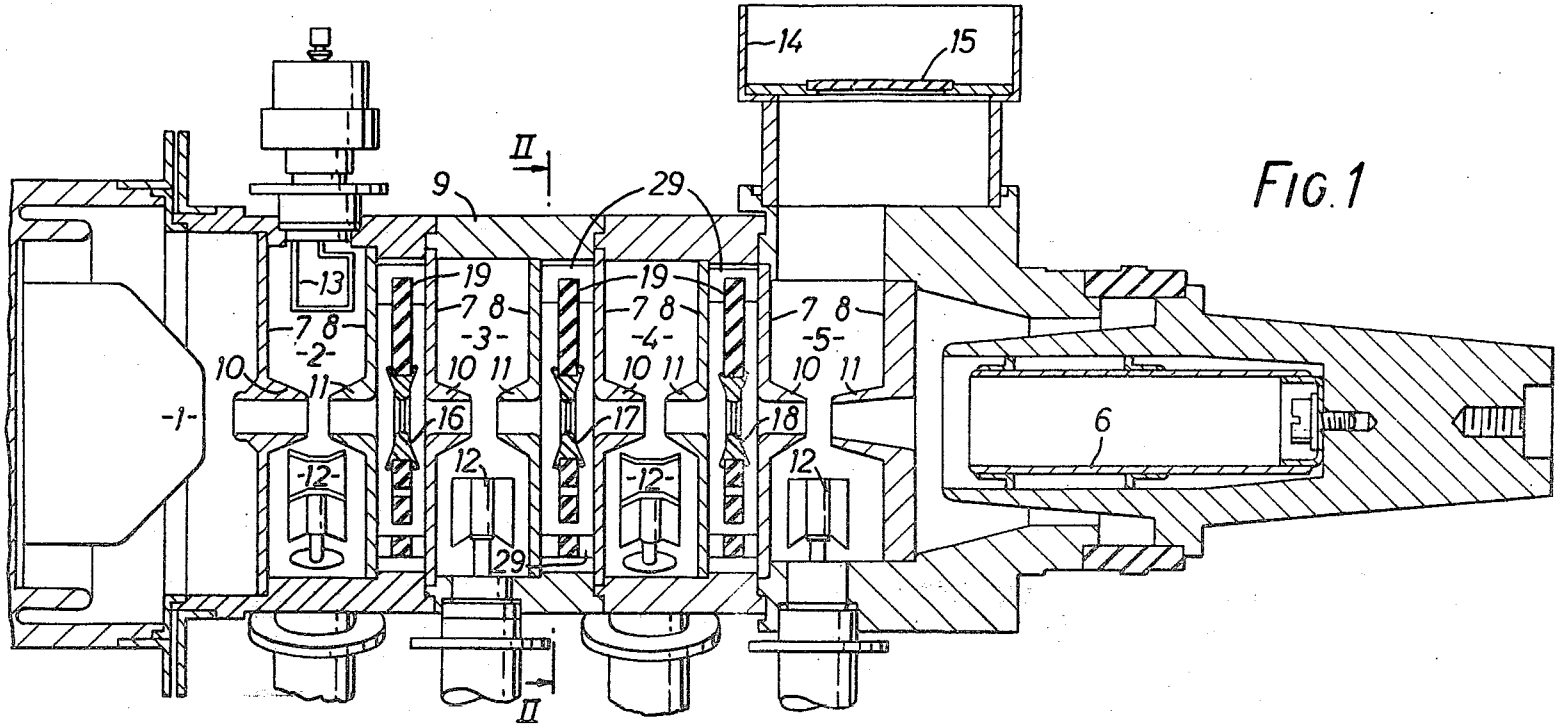
Figure 2:
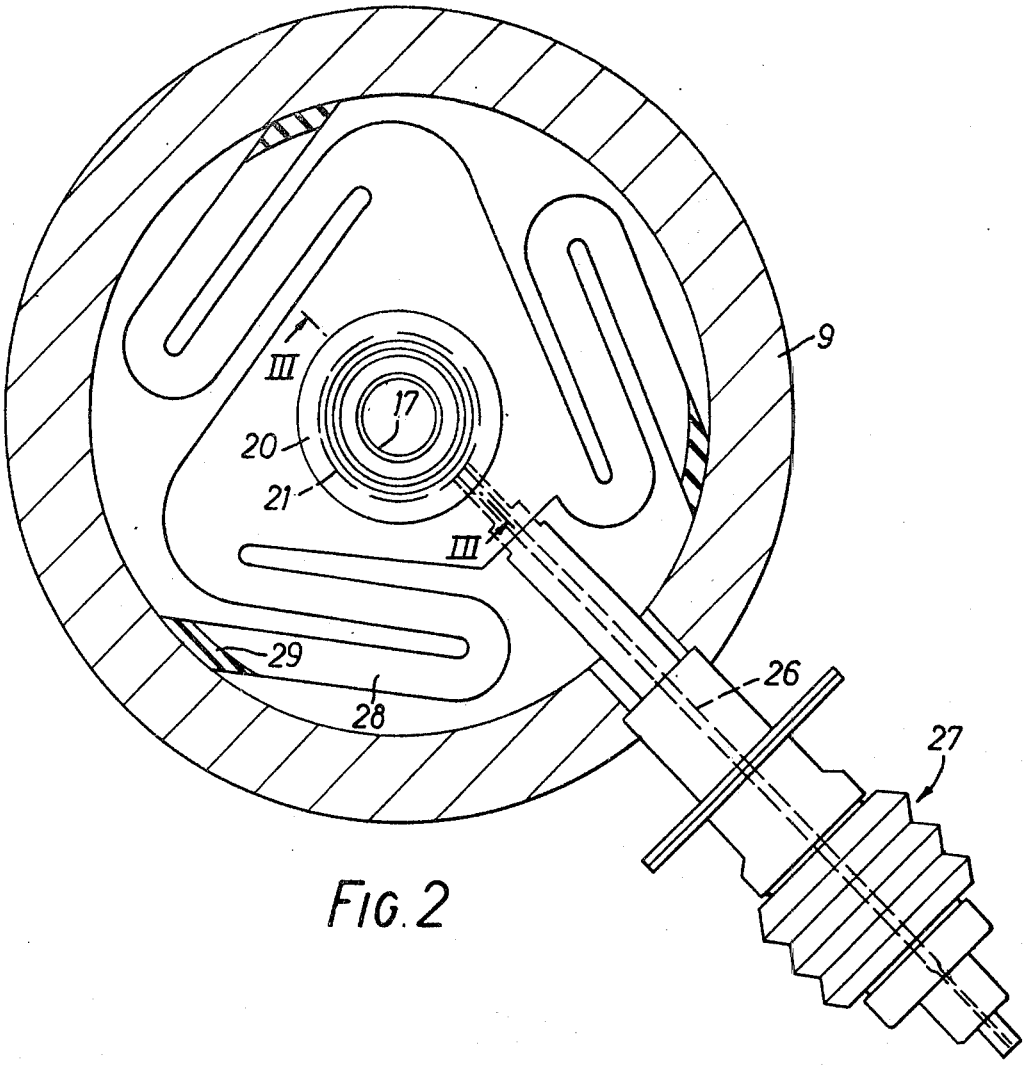
Figure 3:
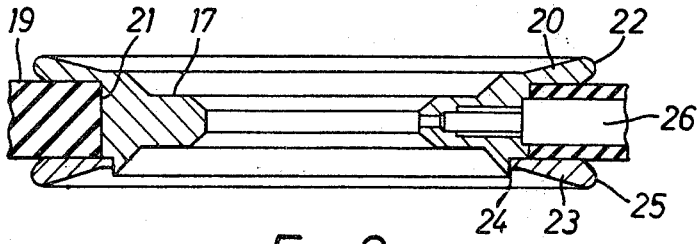
Figure 4:
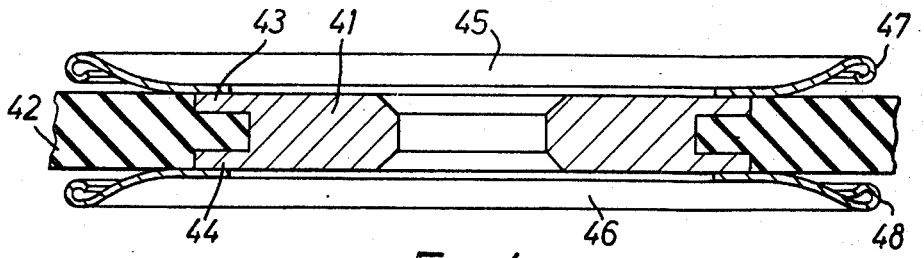
Figure 5:
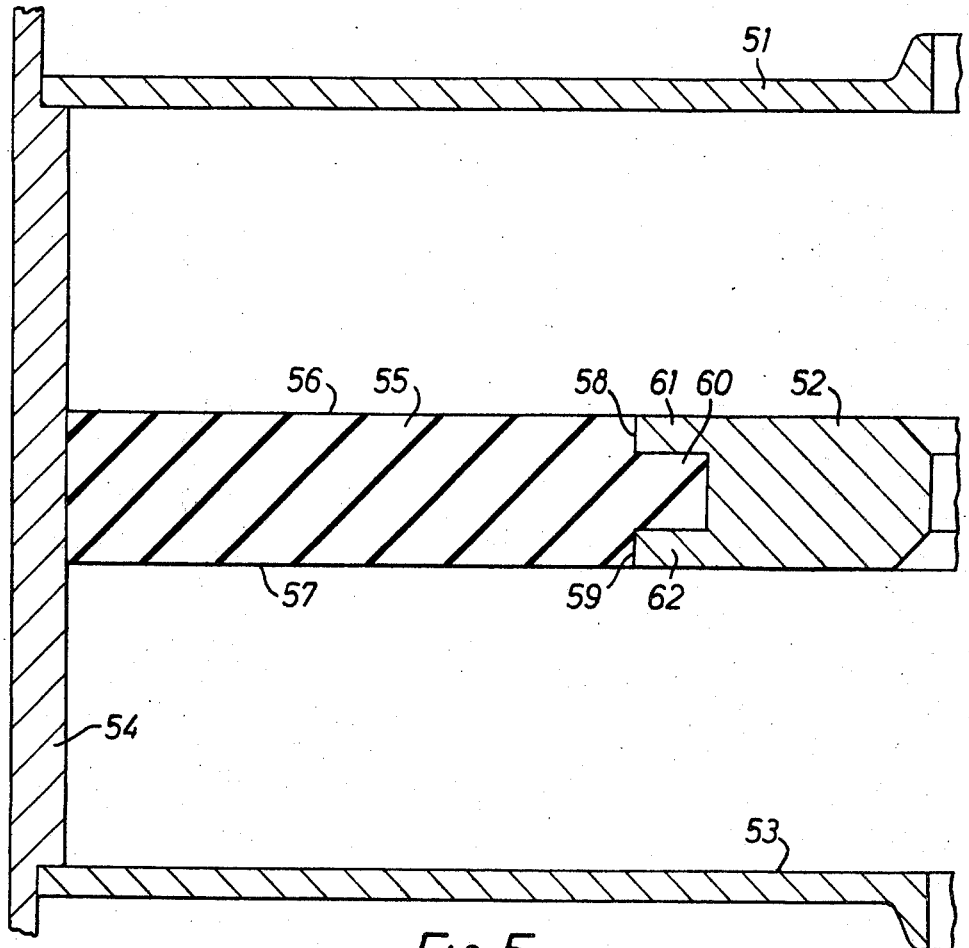

In order that the invention may be clearly understood and readily carried into effect it will now be described by way of example with reference to the accompanying drawings in which:

FIG. 1 illustrates diagrammatically a sectional view of a klystron employing an electrostatic focusing arrangement according to the invention, FIG. 2 illustrates diagrammatically a part sectional view in the direction II—II of FIG. 1 showing an electrode and its insulating support, FIG. 3 illustrates diagrammatically a view in the direction III—III of FIG. 2 showing a sectional view on an enlarged scale of the electrode, the corona shield and part of the insulating support, FIG. 4 illustrates diagrammatically a sectional view of another arrangement of electrode, corona shield and insulating support, the view being similar to FIG. 3, and FIG. 5 is a sectional view of part of an electrostatic focusing arrangement without a corona shield and is used to described how the problem of breakdown occurs.

The potential gradient between two electrodes is perturbed if a dielectric material is inserted between the electrodes. Due to the image charge on the dielectric, the field gradient is enhanced in any gaps between the electrodes and the dielectric. The necessity for a ceramic support insulator in the case of an electrostatic focusing lens causes concomitant problems associated with the resulting high field at the electrode-ceramic interface at the extremity of the support where the conductive electrode is held by the insulator. The intense field increases the rate of the field emission of electrons from minute surface protrusions on the electrode, providing a continuous supply of free electrons, which deviate towards the anode, at the junction.

If the free electrons strike the ceramic insulator, its surface will become charged. Secondary electron emission can also result from the electron bombardment. The secondary electron yield, which is a function of the incident electron energy and angle of impact, will determine the sign of the surface charge.

When the electron impact occurs at a grazing angle to the surface, many secondary electrons can escape and the surface becomes positively charged. The positive charge attracts the electrons back to the surface, and, on impact, further secondary electrons are released. There is also a field component towards the anode, so the electrons are deflected along the insulator surface towards the anode. This continuous process, where secondary electrons leave the insulator, are attracted back to the surface nearer the anode and give rise to more secondary electrons which repeat the process, is known as a 'single surface multipactor' effect.

Eventually the hopping electrons reach the anode and are conducted away leaving a net positive charge on the insulator surface close to the anode. As the "multipactor" process continues the charged region extends slowly backwards towards the cathode, effectively reducing the anode to cathode spacing.

At the cathode-insulator interface some of the free electrons generated by field emission are moving on paths which cause them to strike the insulator almost normally. Electrons impacting at normal incidence tend to channel below the surface, and the secondary electrons produced are less likely to escape, with the result that the insulator close to the cathode becomes negatively charged.

After some time, the positively charged region and the negatively charged regions come sufficiently close to each other so that the breakdown strength of the insulator is exceeded and a discharge occurs. The discharge can cause some of the ceramic to be vaporised filling the interelectrode space with ionised gas. A full scale gas breakdown discharge can then occur involving large currents, only effectively limited by the available power supply.

The initial discharge dissipates the charges on the insulator and if the gas discharge is quenched (by supply voltage drop as current is drawn) the whole process can repeat in a cyclic manner.

The complete breakdown process results from the differential charging of the insulator surface due to electron impact. The impacting electrons, in turn, are generated by a field emission process made possible by the very high field at the cathode-insulator junction. The field around a standard Einzel lens is concentrated at the interface with the insulator, thus exacerbating the problem.

Referring now to FIG. 5 of the drawing, there is shown a radial sectional view of an Einzel lens electrostatic focusing arrangement such as may be used in a klystron tube. The electrostatic focusing lens field is produced by suitable respective potentials applied to three annular electrodes 51, 52 and 53. The electrodes 51 and 53 are supported directly by the conductive envelope 54 of the tube, which is normally held at earth potential. The potential for the electrode 52, which is a high negative potential relative to electrodes 51 and 53, is applied by a lead (not shown) insulatingly sealed through the tube envelope, and electrode 52 is supported from the envelope by an insulating support 55. In this arrangement, the electrode 52 constitutes the "cathode" referred to in the previous description, while the electrodes 51 and 53 and the envelope 54 constitute the "anode".

As previously described, electrons impinge on the surfaces 56 and 57 of the insulating support. In practice a large number of these electrons are generated by field emission at the interfaces 58 and 59 and happen to be on paths which permit them to escape initially. The external fields then curve them into the ceramic surface. Some of the electrons also come from the beam and the breakdown process is therefore more likely when the beam is on and even more likely with R.F. which perturbs the beam and generates more free electrons. Because of the electrostatic field conditions, secondary emission of electrons progresses along these surfaces, from electrode 52 towards the envelope 54 the surfaces 56 and 57 becoming charged progressively positive towards the envelope 54. Electrons also escape from the electrode 52 at the interfaces 58 and 59 with the insulating support 55, the tongue 60 of the support 55 being shielded from the high fields since it is located in a groove in the electrode 52 formed by lips 61 and 62. Some of these electrons burrow into the support 55, instead of escaping, and produce regions of negative charge withing the body of the insulator. As secondary emission continues along the surfaces 56 and 57, the region of high positive charge, which was originally produced in the vicinity of the envelope 54, progresses across the surface 56 and 57 towards the electrode 52. Eventually, the high positive charge reaches the surface portions opposite the embedded regions of high negative charge, and the field produced between these negative charges may exceed the breakdown strength of the insulating material. It was found, in practice, that insulating material having a breakdown strength in excess of 50Kv/mm broke down when the klystron was operated with a beam voltage below 20KV. The reason for this is that the surface and embedded charges attain potentials of approximately positive and negative beam voltage respectively, thus producing an intense field therebetween. In those regions where these positive and negative charges were separated by a sufficiently small distance, the field produced exceeded the breakdown strength of the material of the insulating support. It was found that holes were punched in the insulating support. It is believed that a cloud of insulating material was ejected which then lead to the occurrence of a gas breakdown discharge. Once started, it was found that gas breakdown discharges occurred cyclically at intervals as short as about 30 seconds.

The present invention alleviates this problem by substantially removing one of the contributing factors. It also considerably reduces the other charge generation effect, as a good proportion of the electrons causing the positive surface charging originate in the interfaces 58 and 59 and happen to be on trajectories which initially permit them to escape. In accordance with the invention, a corona shield is provided around the interface between the insulating support and the negative electrode. Hence the interface is shielded from the high fields, and field emission, and resulting electron penetration of the insulating support across the interface is obviated, therefore there is substantially no build up of negative charge in the body of the support. The order of the improvement obtained in practice is a two fold increase in hold off voltage, and a reduction in lens leakage current greater than two orders of magnitude.

Referring now to FIGS. 1 to 3, there is shown an electrostatically focused klystron embodying the invention. The klystron which is illustrated comprises an electron gun 1 including a thermionic cathode, four resonant cavities 2, 3, 4 and 5 and collector electrode 6, arranged in that order along the axis of the klystron. Each of the cavities is formed by two transverse copper walls and by part of the copper envelope of the klystron, the transverse walls being denoted by the references 7 and 8 in the case of each cavity and the copper envelope of the klystron being denoted by the reference 9. The walls 7 and 8 are formed with drift tubes 10 and 11 in known manner, having central apertures which are co-axial. All the cavities have plungers 12 which can be moved radially within the cavities for the purpose of tuning. The cavity 2 is the input cavity and high frequency signals can be fed to this cavity by way of a coupling loop 13. The cavity 5, on the other hand, is the output cavity and is coupled to an output waveguide 14 through a dielectric window 15.

To enable the electrons from the source 1 to be focussed so as to form a concentrated axial beam which passes through the cavities 2, 3, 4 and 5 and is finally collected by the collector electrode 6, electrostatic focussing electrodes 16, 17 and 18 are provided between each pair of cavities. When the klystron is operational, a high negative potential is maintained on the electrodes 16, 17 and 18 relative to the walls 7 and 8 of the cavities and to the envelope 9, and the electrodes 16, 17 and 18 co-act with the apertured walls 7 and 8 to form converging electrostatic lenses. Each of the electrodes 16, 17 and 18 is at a fixed distance from the respective walls 7 and 8 of the two adjacent cavities, and the mounting is achieved, in the case of each focussing electrode, by means of a ceramic insulator 19. Each focussing electrode and insulator is of the same construction and the following description of the electrode 17 and its respective insulator is therefore applicable to all.

The preferred form of the electrode 17 comprises an annular member having on one side thereof an integral annular flange 20 (FIGS. 2 and 3). The flange 20 extends radially outwardly over the surface of the insulating support 19 and constitutes a corona shield on one side. The interface 21 between the electrode 17 and the insulating support 19 provides simple, cheap (especially in terms of grinding the ceramic) and accurate locating means for the electrode 17. The corona shield (flange 20) has a rounded and raised peripheral edge 22 which is spaced from the surface of the support 19. An annular conductive member 23 forms a corona shield on the other side of the electrode and support, and the assembly is secured together by turning over the edge 24 in a simple pressing operation. The annulus 23 has a rounded or raised peripheral edge 25 which is spaced from the surface of the insulating support 19. The high negative operating potential is applied to the electrode 17 by means of a rod 26 screwed into the electrode and hermetically sealed through the envelope 9 in known manner by a stand-off insulator assembly 27. The electrostatic field is strongest aroung the peripheral edges 22 and 25, but is still very much weaker than the field in the interface of previous types of lens, and there is no "field squeezing" effect from the dielectric in the shielded gap. In fact, as field emission increases exponentially with applied field (and requires about $10^7$ volt/meter) field emission will not occur to any significant extent at 22 and 25, if the surfaces are smooth. No electrons are injected into the insulating support 19 because the edges 22 and 25 are spaced from the support 19. The annular groove formed between the flange 20 and annulus 23 is substantially shielded from the electrostatic field, and therefore free electrons are not generated by field emission and are not injected into the insulating support. Thus, regions of high negative charge within the body of the support are prevented from forming. Positive surface charging effects are also reduced. It is this feature (that no free electrons to speak of are generated) that is important, since the enhanced fields caused by the previous type of geometry have been reduced enormously by the corona shield, and field emission is suppressed.

The insulating support 19 is formed as a meander pattern having arms such as 28 which are located axially of the tube by feet such as 29 which engage respective transverse walls 7 and 8. Potentials are applied to electrode 17 by means of the conductive rod 26 sealed through the assembly 27. For a more detailed description of the insulating support 19 and the stand-off insulator assembly 27, attention is directed to the description in British Patent specification No. 1,161,877 or the similar descriptions in U.S. Pat. Nos. 3,449,617 and 3,484,642 or French Patent Specification No. 1500573.

Referring now to FIG. 4, there is shown another corona shield arrangement. An annular electrode 41 is mounted in an insulating support 42 by means of lips such as 43 and 44. The insulating support 42 and the electrode 41 together with the manner of mounting them, may be as described in the aforementioned patent specifications.

A pair of corona shields are provided by annular conductive members 45 and 46 which may be secured to the electrode 41 and/or support 42 in any suitable manner. The shields 45 and 46 have respective turned-over peripheral edges 47 and 48 which are spaced from the insulating support 42. The corona shields 45 and 46 operate in the manner previously described with reference to FIG. 3.

What I claim is:

1. An electron beam discharge tube having electron beam focusing means including first and second appertured co-operative electrodes, in operation of the tube maintained at a potential difference, and an insulating means, an extremity of the insulating means in contact with the second, apertured, beam focusing electrode, supporting the electrode in the tube electrically insulated from the first electrode, said second electrode having an extension of a conductive shield over the insulating means adjacent said extremity in contact with the second electrode and thereby shielding said insulating means against breakdown under said potential difference.

2. A tube according to claim 1 in which the support surrounds an annular second electrode and the conductive shield is an annular extension over the surface of the support.

3. A tube according to claim 1 in which the conductive shield is formed with a smooth edge.

4. A tube according to claim 2 in which the annular extension is spaced from the support surface.

5. A tube according to claim 2 in which the annular second electrode is formed in two parts, one to pass through the support and the other for assembly on the one part to co-operate with the one part to retain the electrode in the support.

* * * * *